United States Patent [19]

Weigert

[11] 4,108,094

[45] Aug. 22, 1978

[54] RUFFLING ATTACHMENT

[75] Inventor: Karl Weigert, Englishtown, N.J.

[73] Assignee: Reliable Attachment Company, New York, N.Y.

[21] Appl. No.: 792,128

[22] Filed: Apr. 29, 1977

[51] Int. Cl.[2] ..... D05B 35/08

[52] U.S. Cl. ..... 112/134

[58] Field of Search ..... 112/134, 135, 132, 133

[56] References Cited

U.S. PATENT DOCUMENTS

| | | | |
|---|---|---|---|
| 2,653,558 | 9/1953 | Kruglick | 112/132 |
| 2,682,843 | 7/1954 | Seaman | 112/134 |
| 3,653,348 | 4/1972 | Baumhaft | 112/134 |

*Primary Examiner*—Peter Nerbun

*Attorney, Agent, or Firm*—Breed, Stairs & Handal

[57] ABSTRACT

A sewing machine attachment for automatically accomplishing a ruffling function is disclosed. Ruffling is performed by a finger means which is positioned to grip a fabric disposed on the work table of the sewing machine when the finger means is advanced toward the needle of the machine. Power for the ruffling operation is coupled by a rotatably mounted member to which the finger means is rotatably secured at a point removed from the axis of rotation of the member. In this manner the finger means is given a reciprocating ruffling motion.

The apparatus of the present invention is extremely advantageous inasmuch as it minimizes the number and weight of reciprocating parts. It is thus able to move efficiently and reliably at high speeds.

12 Claims, 17 Drawing Figures

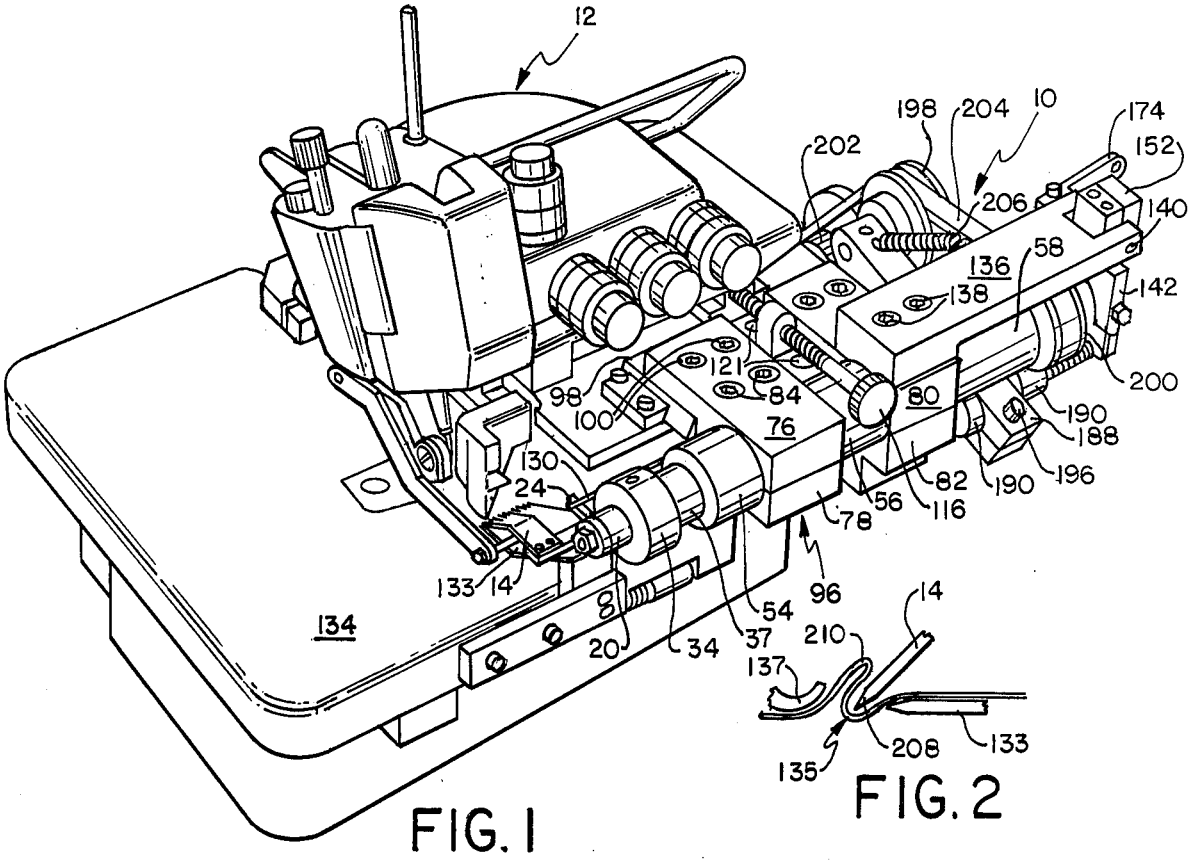
FIG. 1
FIG. 2
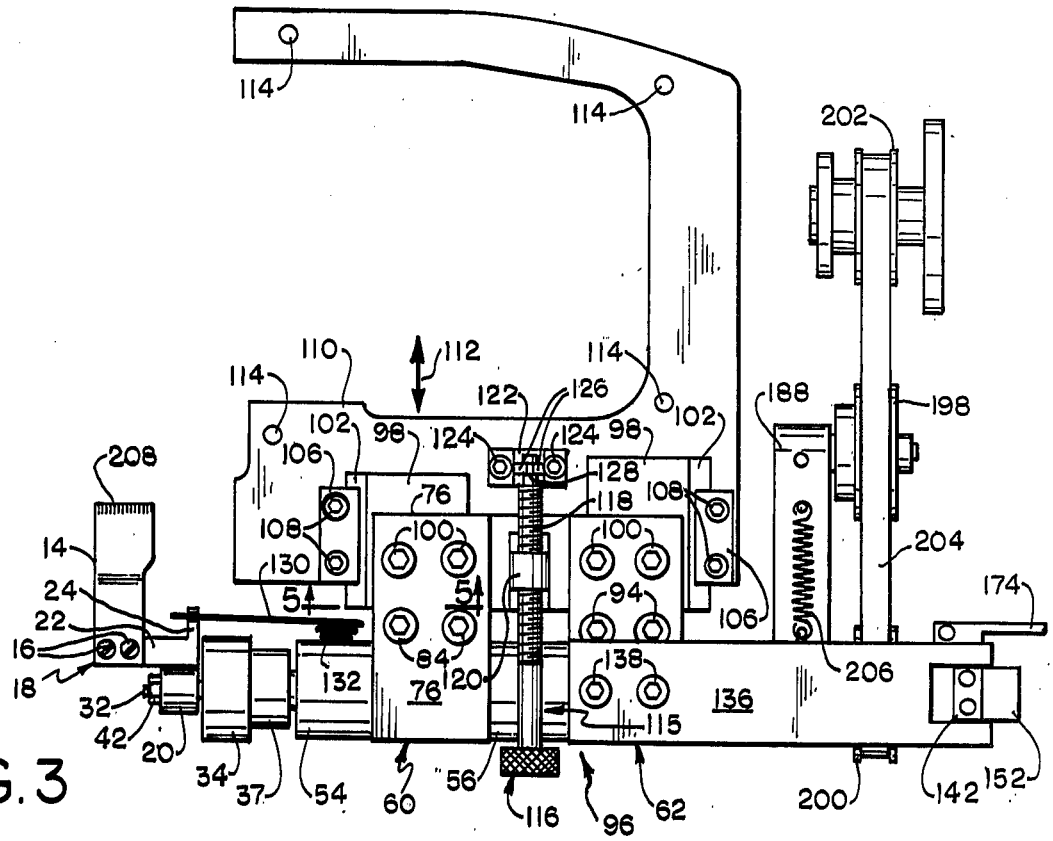
FIG. 3

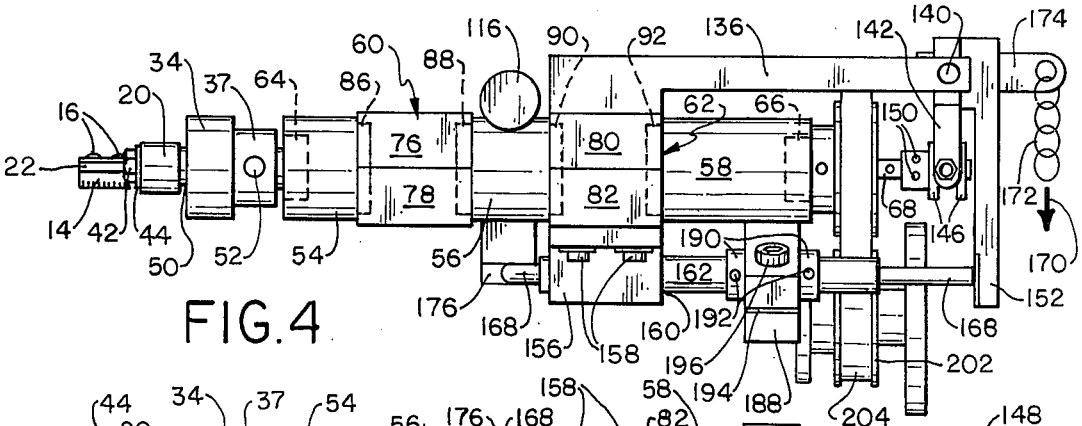
FIG.4
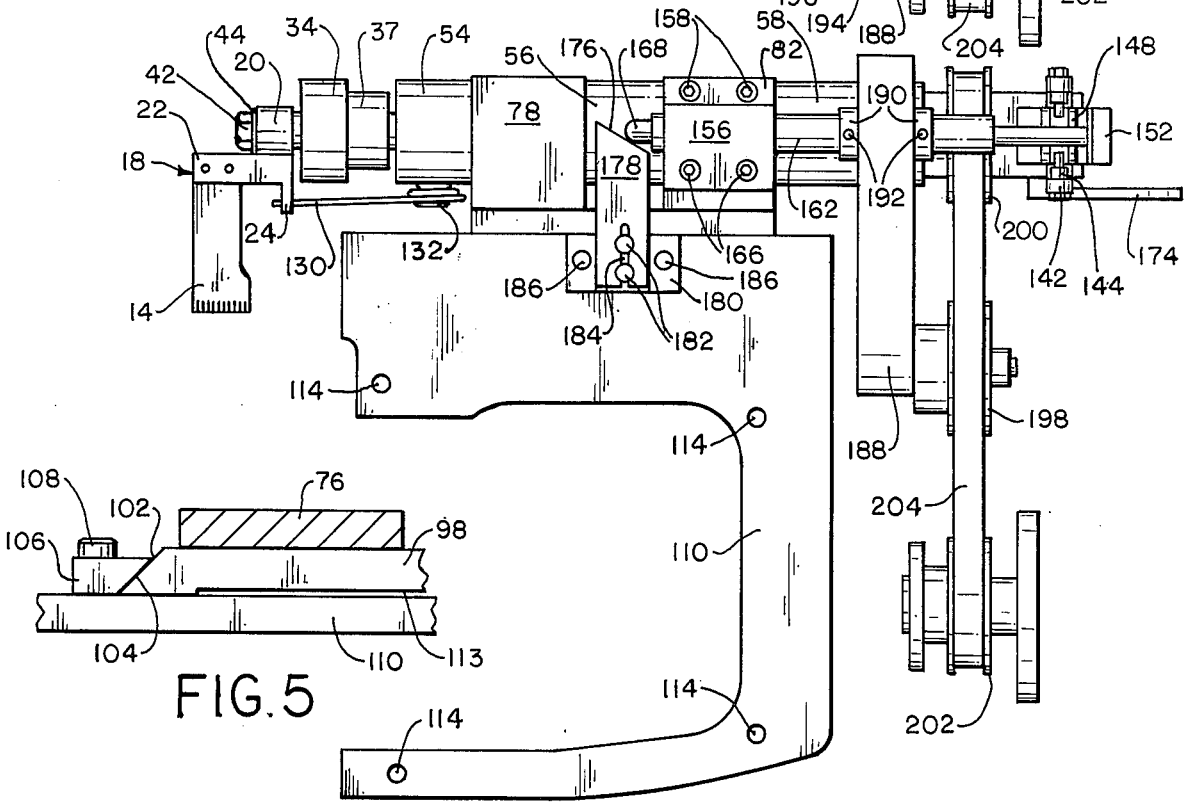
FIG.5
FIG.6
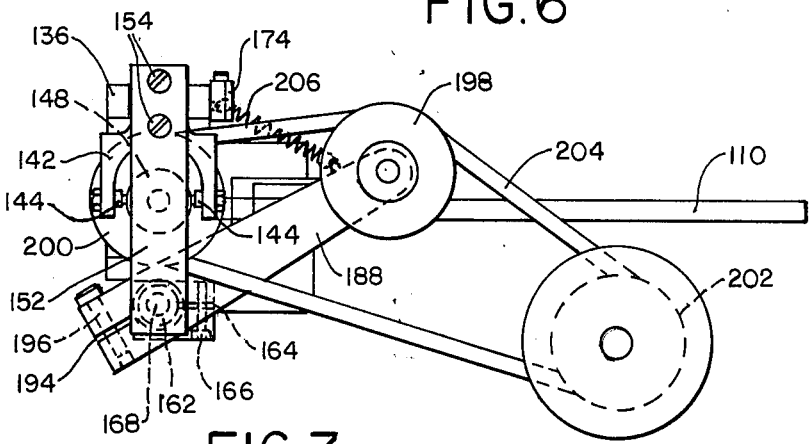
FIG.7

RUFFLING ATTACHMENT

BACKGROUND OF THE INVENTION

In the past, a number of sewing operations involving the gethering together and sewing of material, such as ruffling, pleating and shirring, were performed by hand. Today, however, for most applications, such work is done with the help of automatic machinery.

This machinery is generally an attachment having a ruffling finger which bears against the work table of the sewing machine and the fabric being sewn, and moves in a reciprocating forward-backward motion. The finger grips the fabric being sewn only when it is moving toward the needle of the machine. The gripping portion of such a ruffling finger generally comprises a series of teeth that bear against the fabric at an angle. Thus, they grip the fabric in only one direction of movement. The forward movement of the ruffling finger has the effect of advancing material into the sewing machine at a greater than normal rate thus causing the machine to sew an extra amount of fabric, with the fabric lying over itself. The configuration that the fabric takes depends upon the frequency with which the ruffling finger reciprocates. For example, if the ruffling finger reciprocates once per stitch, a ruffle will result. If the finger reciprocates once for a number of stitches, a pleat will result from its reciprocating motion. We shall use the word "ruffling" and "ruffle" for the sake of convenience in referring to all operations involving the gathering together and sewing of material into a ruffle-like or pleat-like configuration.

Generally, prior art ruffling attachments achieve a reciprocating ruffling finger motion by mounting the finger on a bar which extends the length of the sewing machine and is rotatably mounted above the work table, extending between the needle end of the machine and the end of the machine on which is mounted the wheel by which the machine is driven. A lever arm extending at a right angle from the bar is secured to the bar at the end adjacent the drive wheel of the machine. A drive bar is rotatably mounted at both its ends, on one end to the end of the lever arm and on the other end to the drive wheel at a point on the wheel that is displaced from its axis of rotation. Rotary motion of the drive wheel thus results in imparting a reciprocating rotary motion to the bar to which the ruffling finger is attached. This reciprocating rotary motion, in turn, gives the ruffling finger a reciprocating motion.

With the increasing popularity of high-speed sewing machines, however, such automatic rufflers are increasingly becomming the weak link in an otherwise very time-efficient operation.

Due to the length, flexibilty, number and weight of the parts of such prior art rufflers and the fact that these parts are subjected to reciprocating motion, they are unable to function at high speeds. For the same reasons they are also especially prone to becomming damaged or worn. It is the object of the present invention to provide a high-speed ruffling attachment for a sewing machine that is capable of reliable and trouble-free operation at high speeds.

SUMMARY OF THE INVENTION

In accordance with the present invention, a ruffling attachment for a sewing machine comprises finger means which is adapted to grip a fabric being sewn by a sewing machine as the finger means is advanced toward the needle of the sewing machine. Support means is adapted to be secured to the sewing machine. Power coupling means is rotatably mounted on the support means. Mounting means is provided for rotatably supporting the finger means on the power coupling means at a point removed from the axis of rotation of the power coupling means whereby rotation of the power coupling means causes a reciprocal movement in the finger means.

In accordance with the preferred embodiment of the invention the support means may be adjusted to maintain the power coupling means at a desired position relative to the sewing machine. The operation of the mounting means is responsive to that desired position to vary the distance by which said point is removed from the axis of rotation of the power coupling means, whereby the magnitude of reciprocal movement by the finger means may be increased without varying the most forward position of the finger means. Such variation in the magnitude of the finger means' reciprocal movement allows one to vary the amount of fabric sewn into the ruffle.

BRIEF DESCRIPTION OF THE DRAWINGS

The operation and advantages of the invention will become apparent from the following detailed description taken in conjunction with the drawings, in which:

FIG. 1 is a perspective view of a sewing machine with the inventive ruffling attachment secured to it;

FIG. 2 is a schematic representation of the ruffling finger and its operation;

FIG. 3 is a top plan view of the inventive ruffling attachment;

FIG. 4 is a front elevational view of the inventive ruffling attachment;

FIG. 5 is a detailed view in cross-section showing a part of the structure responsible for relative movement between the bracket means and the slidable support means;

FIG. 6 is a bottom plan view of the inventive ruffling attachment;

FIG. 7 is a side elevational view of the inventive attachment;

DETAILED DESCRIPTION OF THE PREFERRED EMBODIMENT

Figure 8:
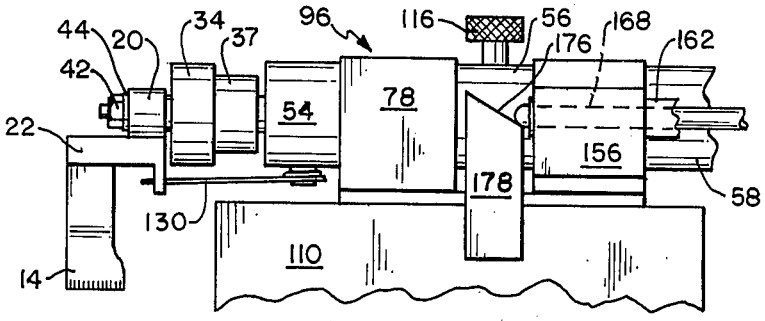
FIG. 8 is a partial bottom plan view showing the attachment when the unit is adjusted for no ruffling.

Referring to FIG. 1, a perspective view of the inventive ruffling attachment 10 attached to a conventional sewing machine 12 is illustrated. As shown in FIGS. 3–8, the attachment comprises a ruffling finger 14, which is secured by a pair of screws 16 to an arm 18. Arm 18 comprises an annular sleeve 20 (FIG. 8) which is secured to and integral with a support plate 22 on which ruffling finger 14 is mounted. Arm 18 also includes a spring receiving stud 24.

Referring to FIGS. 8–11, arm 18 is rotatably mounted on a sleeve 26 which in turn is mounted on a movable lever arm 28. Movable lever arm 28 includes a camming portion 30 and an axle portion 32. Camming portion 30 is housed within an annular housing 34 and slidably mounted therein whereby it is allowed to slide between a pair of track elements 36 on a track member 37 from the position illustrated in FIG. 9 to the position illustrated in FIG. 16. Camming portion 30 is biased in the position illustrated in FIG. 10 by a spring 38. In this position, axle portion 32 is centered on housing 34 and retained therein by track portions 40 of track members 36. Housing 34 is secured to track member 37 by screws 46.

The annular portion 48 of track member 37 is secured to an elongated sleeve 50 by a locking bolt 52. As is shown most clearly in FIGS. 3–4 elongated sleeve 50 is rotatably mounted within a housing assembly comprising sleeves 54, 56 and 58 and support block assemblies 60 and 62. Friction in the rotation of elongated sleeve 50 is kept to a minimum by rotatably mounting sleeve 50 in sleeves 54 and 58 with a pair of ball bearing assemblies 64 and 66.

Figure 10:
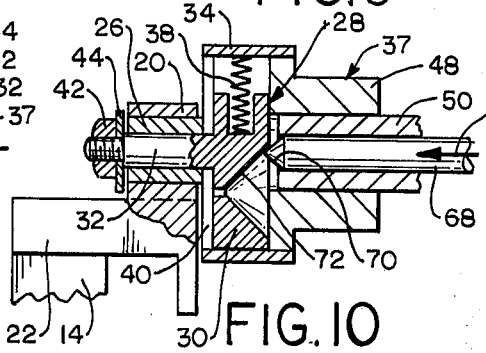
FIG. 10 is a cross-sectional view of the mounting means when the attachment is adjusted as in the position illustrated in FIG. 8.
Figure 11:
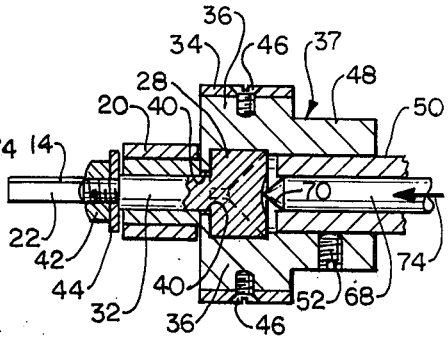
FIG. 11 is a cross-sectional view along line 11—11 of FIG. 10.
Figure 15:
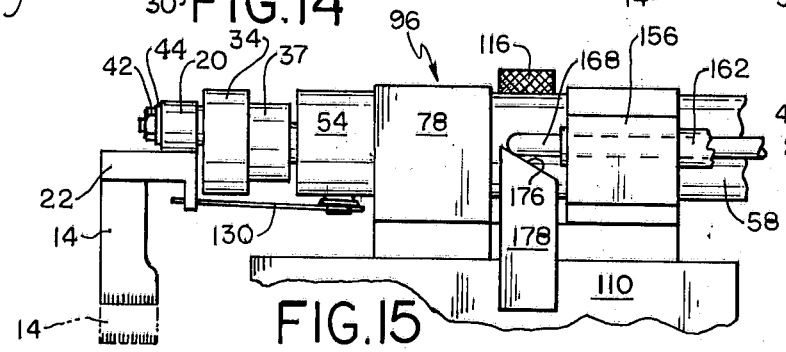
FIG. 15 is a partial bottom plan view similar to that illustrated in FIG. 12, with the attachment adjusted for a relatively large ruffle.
Figure 16:
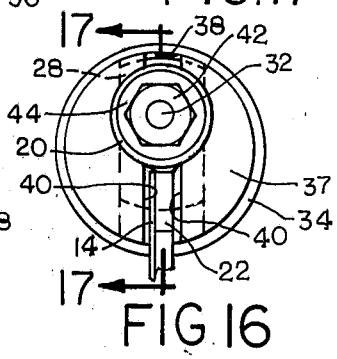
FIG. 16 is an end view of the attachment similar to that illustrated in FIG. 9 with the attachment in the position illustrated in FIG. 15.

A bar 68 is slidably mounted within elongated sleeve 50 (FIG. 10). Bar 68 includes a cam operating surface 70 which cooperates with a cam surface 72 on movable lever arm 28. Cam surface 72 is formed as illustrated in order that application of a force against bar 68 in the direction indicated by arrow 74 results in the movement of bar 68 in the direction indicated by arrow 74 and a corresponding movement by movable lever arm 28 from the position illustrated in FIG. 10 in a direction toward the position illustrated in FIG. 17. This in turn results in moving the point of rotation of arm 18 away from the center, as is illustrated in phantom in FIG. 15, toward the perimeter of the housing, as illustrated in FIG. 16.

Referring to FIG. 1, support block assembly 60 comprises an upper member 76 and a lower member 78. Support block assembly 62 comprises an upper member 80 and a lower member 82. Members 76 and 78 are held together by bolts 84 with their inner surfaces engaging and securely holding the shoulders 86 and 88 (FIG. 4) of sleeves 54 and 56, respectively. In turn, upper and lower members 80 and 82 of support block assembly 62 engage shoulders 90 and 92 of sleeves 56 and 58 through the clamping action of bolts 94 which draw the upper and lower members into secure gripping relationship with the sleeves. Thus, sleeves 54, 56 and 58 together with support block assemblies 60 and 62 form a single housing assembly 96. Housing 96 is secured to a slidable support plate 98 by bolts 100. Slidable support plate 98 includes guide surfaces 102 (FIG. 5) which meet with mating guide surfaces 104 on a pair of track members 106. Track members 106 are in turn secured by bolts 108 to a mounting bracket 110. Thus, housing 96 is free to be displaced in the directions indicated by arrow 112 (FIG. 3). Such movement is facilitated by milling away a portion of the undersurface 113 of slidable support plate 98. Mounting bracket 110 includes a number of holes 114 which allow it to be secured to a sewing machine 12 as is illustrated in FIG. 1.

Slidable movement of housing 96 relative to mounting bracket 110 and, hence, sewing machine 12 is accomplished by bolt assembly 115 (FIG. 3). The assembly comprises a bolt 116 which includes threads 118, a bracket 120 which is secured to slidable support member 98 by a pair of bolts 121 and which includes a tapped hole through which bolt 116 is received, and a bracket 122. Bracket 122 is secured by bolts 124 to mounting bracket 110. Bracket 122 also includes a pair of fingers 126 which engage an annular groove 128 on bolt 116 and allow only rotary movement of bolt 116 relative to bracket 122. Instead, when bolt 116 is rotated, bracket 120 is displaced, thus causing relative motion, in the directions indicated by arrow 112, between housing 96 and mounting bracket 110 which is stationary relative to sewing machine 12.

A spring 130 is secured to sleeve 54 by a bolt 132. Spring 130 is a spiral spring which is so secured by bolt 132 relative to sleeve 54 that it resiliently urges ruffling finger 14 toward the work table 134 of sewing machine 12 by being coupled to the spring receiving groove on the spring receiving stud 24. A lower finger 133 is secured to the machine to prevent backward movement of fabric 135 during backward movement of finger 14 away from sewing machine foot 137.

An actuator support plate 136 is secured to upper member 80 by a pair of bolts 138. The end of actuator support plate 136 opposite the end at which it is mounted on upper member 80 terminates in a clevis. Referring to FIGS. 4, 6 and 7, a bar 140 passes rotatably through said clevis. Secured to said bar is a second clevis 142. Mounted within the legs of this clevis are a pair of studs 144. These studs fit between plates 146 of spool 148 which is secured to the end of bar 68 by a pair of locking bolts 150. A motion limiting member 152 is secured to clevis 142 by a pair of bolts 154. A lower support block 156 includes a bore 160 within which an elongated sleeve 162 is mounted. Block 156 also includes a slot 164 extending from bore 160. Bolts 166 pass through block 156 on both sides of slot 164. Thus, tightening of bolts 166 results in securely holding elongated sleeve 162 in position. Slidably mounted within sleeve 162 is a bar 168. Bar 168 is laterally displaced by rotation of clevis 142 and motion limiting member 152 coupled to it. Rotation of clevis 142 is achieved by applying force, in the direction indicated by arrow 170, to a chain 172 which is coupled to an arm 174. Arm 174 is in turn rigidly coupled to bar 140 to which clevis 142 is rigidly secured. Lateral displacement of bar 168 within elongated sleeve 162 is limited by the surface 176 of a stop 178. Stop 178 is mounted on a bracket 180 which in turn is mounted on mounting bracket 110. Stop 178 may be adjustably mounted by sliding it to the desired position when bolts 182 are in slot 184, which is incorporated within stop 178. Bracket 180 is, in turn, secured to mounting bracket 110 by a pair of bolts 186.

An idler support arm 188 is rotatably mounted on elongated sleeve 162. It is kept in position by a pair of annular stops 190 which are secured to elongated sleeve 162 by a pair of bolts 192 and urged into the desired position by a spring 206. Idler support arm 188 also includes a slot 194 and a bolt 196. Bolt 196 may be tightened to secure the arm in the desired angular position in a non-rotatable fashion. Referring to FIG. 7, in particular, we note the method by which rotary motion is imparted to the inventive sewing machine attachment. Specifically, idler arm 188 is provided with an idler gear 198. A drive gear 200 is secured to elongated sleeve 50. Thus, rotation of drive gear 200 causes rotation of annular portion 48. Rotary drive is coupled to gear 200 from a gear 202 coupled to a source of rotary drive on the sewing machine. Coupling between gear 202, idler 198 and drive gear 200 is accomplished by a belt 204.

Operation

Figure 9:
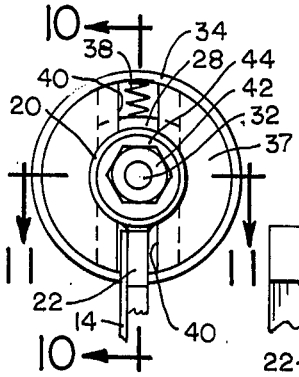
FIG. 9 is an end view of the attachment when it is in the position illustrated in FIG. 8.

When it is desired to operate the sewing machine without ruffling the fabric which is being sewn, one simply does not apply any force to chain 172. Thus, bar 68 is in the retracted position illustrated in FIG. 10 and axle portion 32 is centered on the housing as is illustrated in FIG. 9. Such operation can be insured even in the event that a force is applied to chain 172 by rotating bolt 116 to an annular position where the relative position between mounting bracket 110 and housing 96 is such that when force is applied to chain 172, motion limiting member 152 is angularly displaced into contact with bar 168 which is advanced only to the position shown in FIG. 8. This prevents further displacement of member 152, and corresponds to the positioning of bar 68 in the position shown in FIGS. 10 and 11. In this position housing 34, member 37 and arm 28 rotate and the point of rotation of axle portion 32 is centered on housing 34, thus resulting in no reciprocal motion on the part of ruffling finger 14, which simply acts as a passive element during the sewing of material by sewing machine 12.

Figure 12:
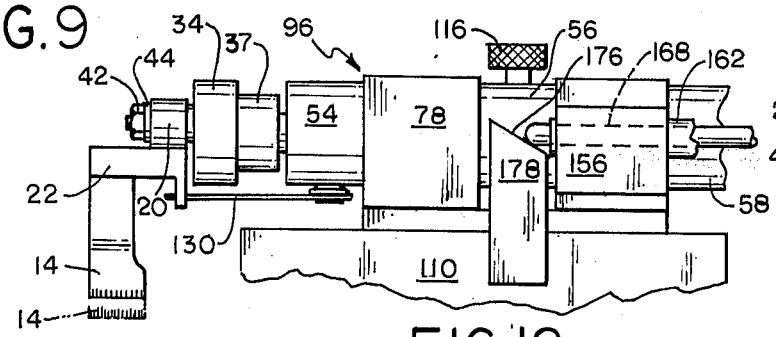
FIG. 12 is a partial bottom plan view of the inventive attachment similar to that illustrated in FIG. 8 with the attachment adjusted for a relatively small ruffle.
Figure 13:
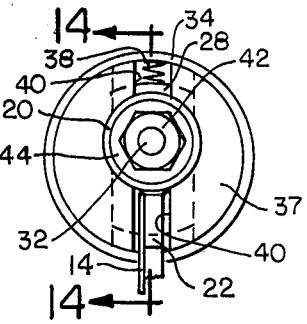
FIG. 13 is an end view of the attachment when it is in the position illustrated in FIG. 12.
Figure 14:
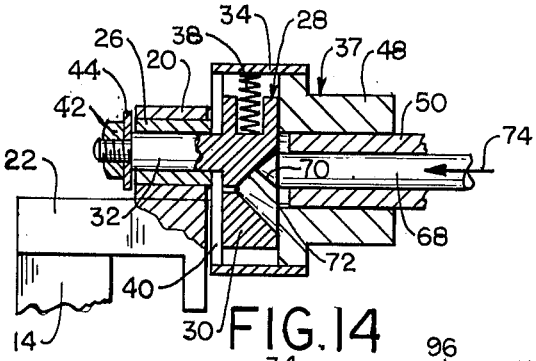
FIG. 14 is a cross-sectional view along line 14—14 of FIG. 13.
Figure 17:
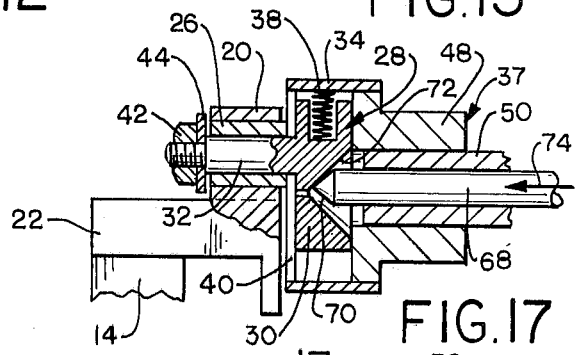
FIG. 17 is a cross-sectional view of the attachment illustrated in FIG. 15 along line 17—17 of FIG. 16.

In the event that it is desired to ruffle the materials being sewn by the machine, which may comprise, for example, the body of a skirt and a decorative ribbon, the two fabrics will be fed into the machine in the conventional manner by the operator However, prior to the commencement of the sewing operation, bolt 116 would be rotated to an angular position where housing 96 is further from mounting bracket 110 and the sewing machine. This condition is illustrated in FIGS. 15–17. If no force is applied to chain 172, the position of axle portion 32 is substantially that shown in FIGS. 8–11 and there is no reciprocating motion in ruffling finger 14. Thus, the ruffling finger 14 acts as a passive element and does not change the sewing by the machine in the conventional manner. However, when a force is applied to chain 172 member 152 is rotated and displaces drive bar 68. Moreover, because housing 96 is further displaced from mounting bracket 110 and surface 176, bar 168 can advance to a further position as is illustrated in FIG. 15. This results in displacing camming portion 30 from the position into which it is biased by spring 38, as shown in FIG. 10, to the position illustrated in FIG. 17. In this position axle portion 32 is displaced from the center and rotation of gear 200 causes a rotation of sleeve 50 and a corresponding reciprocating motion in ruffling finger 14. This reciprocating motion by ruffling finger 14, when it is in the backward direction does not affect the sewing operation because the fabric 135 is held by the sharply-toothed edge of lower finger 133. However, in the forward direction, the leading sharply-toothed edge 208 of the ruffling finger grips the fabric being fed into the sewing machine and forms it into a loop 210 which is fed into the machine, thus forming a ruffle. As the machine is operated a series of ruffles are formed. If a relatively shallow ruffle is desired bolt 116 may be adjusted to put housing 96 in a position between that illustrated in FIG. 8 and that of in FIG. 15 as illustrated in FIGS. 12–14.

In order for ruffling to be properly done, it is necessary that in its reciprocating movement ruffling finger 14 always meets the same extreme forward position, that is to say that the closest position of the ruffling finger to the head of the sewing machine must be very close to the head, and be substantially free of variance regardless of the depth of the ruffle. The mechanism of the instant invention is particularly advantageous in this regard, because as the deepness of the reciprocating motion of the ruffling finger is increased about the center point of housing 34, the distance of the centerpoint of housing 34 from the machine is also being increased.

Maintenance of the desired uniformity in the most extreme foward position of the ruffling finger can be maintained by keeping surfaces 72 and 176 linear. An angle substantially equal to that illustrated in FIG. 8 is selected for surface 72. Bar 68 is put in a position where it is just barely not displacing camming portion 30 and the end of bar 168 is in contact with one end of surface 176. Bolt 116 is then rotated to the point where edge 208 is in the position which is desired to be the most forward point of its reciprocating motion. Stop 178 is then positioned substantially as shown in FIG. 8. Bolt 116 is then rotated to bring housing 96 to the position illustrated in FIG. 15. While maintaining the first end in the desired position, the other end of surface 176 is adjusted to a position where, with the end of member 152 bearing against bar 168, and the other end of bar 168 against that end of surface 176, the edge of ruffling finger 14 is, in its extreme forward position, in the same position that is desired as the extreme forward ruffling position. This type of adjustment is possible because in addition to allowing lateral motion, bolts 182 also allow some measure of transverse motion, and thus some, though limited, rotation.

In practice, when it is desired to actuate the ruffling attachment, a force is applied to chain 172 in the direction indicated by arrow 170. Such force may be applied by attaching chain 172 to a foot pedal or other conventional device. Thus, when the operator of the sewing machine wishes to begin ruffling, he simply depresses the pedal pulling chain 172 in the direction indicated by arrow 170 and actuating the ruffling assembly. Naturally, the depth of the ruffle will be determined by the adjustment of bolt 116. As is illustrated in FIGS. 8, 12 and 15 the back and forth displacement of ruffling finger 14 will vary between the limits indicated by the full line and phantom line illustrations of finger 14. When the operator removes his foot from the pedal and thus ceases in the application of force to chain 172, spring 38 pushes camming portion 30 and bar 68 to the positions illustrated in FIG. 10, thus restoring the parts of the attachment to the non-ruffling mode.

While a preferred embodiment of the invention has been disclosed, it is of course understood that various modifications of the apparatus will be obvious to those of ordinary skill in the art. Such modifications are within the spirit and scope of the invention which is limited and defined only by the appended claims.

We claim:

1. A sewing machine attachment, comprising:

(a) finger means positioned, configured and dimensioned to grip a fabric disposed on the work table of a sewing machine when said finger means is advanced toward the needle of said machine;

(b) support means adapted to be secured to said sewing machine;

(c) power coupling means rotatably mounted on said support means;

(d) means for coupling a continuous rotary motion to said power coupling means; and (e) mounting means for rotatably supporting said finger means on said power coupling means at a point removed from the axis of rotation of said power coupling means whereby said mounting means is rotated and imparts a reciprocating motion to said finger means.

2. A sewing machine attachment as in claim 1, wherein said support means comprises:

(a) bracket means adapted to be secured to said sewing machine;

(b) slidable support means for supporting said power coupling means;

(c) means for slidably supporting said slidable support means on said bracket means; and (d) means for varying the position of said slidable support means relative to said bracket means.

3. A sewing machine attachment as in claim 2, wherein said means for slidably supporting said slidable support means comprises track means configured and dimensioned to mate with and slidably secure said slidable support means.

4. A sewing machine attachment as in claim 1 wherein said support means may be displaced to maintain said power coupling means at a desired position relative to the sewing machine and wherein the operation of said mounting means is responsive to the magnitude of displacement of the support means to vary the distance by which said point is removed from the axis of rotation of said power coupling means.

5. A sewing machine attachment as in claim 4, wherein the most forward position of said point when said mounting means is rotated on said power coupling means is substantially the same for different positions of said power coupling means relative to said sewing machine.

6. A sewing machine attachment as in claim 5, wherein said mounting means for rotatably supporting said finger means comprises a cam that is slidably supported by a guide means secured to said power coupling means, and wherein said power coupling means defines an elongated passage, and further comprising a bar enclosed within said passage, one end of said bar being in engagement with said cam, and spring means biasing said cam into a position where said point is not displaced from the axis of said power coupling means, said cam being so configured, deminsioned and positioned that the application of force to said bar causes movement of said cam and displacement of said point away from the axis of rotation of said power coupling means.

7. A sewing machine attachment as in claim 6, wherein said force is applied by a mechanism which is stationary with respect to said power coupling means and whose motion is limited by bearing against a surface, said surface being stationary with respect to said sewing machine, whereby variation in the position of the power coupling means results in a corresponding variation in the extent to which said mechanism is allowed to move and thereby the extent to which said point is displaced from the axis of rotation of the power coupling means.

8. A sewing machine attachment as in claim 1, wherein said support means comprises:

(a) bracket means adapted to be secured to said sewing machine;

(b) moveable support means for supporting said power coupling means;

(c) means for moveably supporting said moveable support means on said bracket means; and (d) means for varying the position of said moveable support means relative to said bracket means.

9. A sewing machine attachment, comprising:

(a) finger means positioned, configured and dimensioned to grip a fabric disposed on the work table of a sewing machine when said finger means is advanced toward the needle of said machine.

(b) support means adapted to be secured to said sewing machine, said support means comprising:

(i) bracket means adapted to be secured to said sewing machine;

(ii) moveable support means for supporting said power coupling means;

(iii) means for moveably supporting said moveable support means on said bracket means; and (iv) means for varying the position of said moveable support means relative to said bracket means, said means for varying the position of said moveable support means comprising:

($\alpha$) first engaging bracket means secured to said slidable support means;

($\beta$) second engaging bracket means secured to said bracket means; and p3 ($\gamma$) threaded bolt means, threadedly engaging either said first or said second engaging bracket means and rotatably secured to the other engaging bracket means;

(c) power coupling means mounted for angular displacement on said support means; and (d) mounting means for rotatably supporting said finger means on said power coupling means at a point removed from the axis of rotation of said power coupling means.

10. A sewing machine attachment, comprising:

(a) finger means positioned, configured and dimensioned to grip a fabric disposed on the work table of a sewing machine when said finger means is advanced toward the needle of said machine;

(b) support means;

(c) displaceable means for displaceably supporting said support means on the sewing machine whereby said support means may be displaced to a desired position relative to the sewing machine;

(d) power coupling means mounted for angular displacement on said support means; and (e) mounting means for rotatably supporting said finger means on said power coupling means at a point removed by a distance from the axis of rotation of said power coupling means, said mounting means being responsive to the position of the support means to vary the distance by which said point is removed from the axis of rotation of said coupling means.

11. A sewing machine attachment, comprising:

(a) finger means positioned, configured and dimensioned to grip a fabric disposed on the work table of a sewing machine as said finger means is advanced toward the needle of said machine;

(b) power coupling means for supporting said finger means;

(c) means for supporting said power coupling means and imparting a reciprocating movement to said finger means, said reciprocating movement being relative to a desired selectable position relative to the sewing machine; and (d) means for varying the magnitude of said reciprocating movement responsive to the selectable position, relative to the sewing machine, about which the finger means reciprocates to give smaller magnitudes of reciprocation for positions, close to the sewing machine, about which the finger means reciprocates.

12. A sewing machine attachment as in claim 11, wherein said means for supporting said power coupling means comprises:

(a) a rotatably mounted member; and (b) means, mounted on said rotatably mounted member pivotally supporting said power coupling means at a desired point removed from the axis of rotation of the rotatably mounted member, the magnitude of the removal of said point being responsive to said means for varying the magnitude of said reciprocating movement, whereby rotation of said rotatably mounted member results in imparting a reciprocal motion of selectable magnitude to said finger means.

* * * * *